US011828286B2

(12) United States Patent
Lee

(10) Patent No.: US 11,828,286 B2
(45) Date of Patent: Nov. 28, 2023

(54) WATER-RING VACUUM PUMP INCLUDING BUILT-IN HOGGING FLOW PATH

(71) Applicant: Vaccomp Co., Ltd., Incheon (KR)

(72) Inventor: Seok Won Lee, Incheon (KR)

(73) Assignee: VACCOMP CO., LTD., Incheon (KR)

( * ) Notice: Subject to any disclaimer, the term of this patent is extended or adjusted under 35 U.S.C. 154(b) by 0 days.

(21) Appl. No.: 17/929,794

(22) Filed: Sep. 6, 2022

(65) Prior Publication Data

US 2023/0146497 A1 May 11, 2023

(30) Foreign Application Priority Data

Nov. 9, 2021 (KR) ..... 10-2021-0152732

(51) Int. Cl.

| | |
|---|---|
| ***F04C 19/00*** | (2006.01) |
| ***F04C 25/02*** | (2006.01) |
| ***F04C 27/02*** | (2006.01) |
| ***F04C 28/26*** | (2006.01) |

(52) U.S. Cl.

CPC ..... *F04C 19/005* (2013.01); *F04C 19/004* (2013.01); *F04C 25/02* (2013.01); *F04C 27/02* (2013.01); *F04C 28/26* (2013.01); *F04C 2220/10* (2013.01)

(58) Field of Classification Search

CPC ..... F04C 19/00–19/008; F04C 25/00; F04C 25/02; F04C 27/02; F04C 2220/10; F04C 28/065; F04C 28/24; F04C 28/26

See application file for complete search history.

(56) References Cited

U.S. PATENT DOCUMENTS

| | | | | |
|---|---|---|---|---|
| 2008/0038120 | A1* | 2/2008 | Lengyel | F04C 19/00 417/68 |
| 2015/0093260 | A1* | 4/2015 | Beers | F04C 19/007 417/68 |
| 2020/0217318 | A1* | 7/2020 | Lee | F04C 19/005 |

FOREIGN PATENT DOCUMENTS

| | | |
|---|---|---|
| JP | 2005344511 | 12/2005 |
| KR | 20160060763 | 5/2016 |
| WO | 2015-050595 | 4/2015 |

* cited by examiner

*Primary Examiner* — Bryan M Lettman

(74) *Attorney, Agent, or Firm* — LEX IP MEISTER, PLLC

(57) ABSTRACT

A water-ring vacuum pump including a built-in hogging flow path. The water-ring vacuum pump includes a first-stage body, a second-stage body, and an impeller. The first-stage body includes a gas inlet port through which gas is suctioned and a seal water supply port through which seal water is supplied. The second-stage body includes a mixed fluid outlet port through which a mixed fluid of the gas and the seal water is discharged. The first-stage body has a fluid-mixing space provided therein, the fluid-mixing space having a mixed flow of the gas and the seal water therein. The second-stage body has a fluid guide space and an internal hogging flow path provided therein, the internal hogging flow path communicating with the fluid guide space.

4 Claims, 7 Drawing Sheets

[FIG. 1]
Prior Art
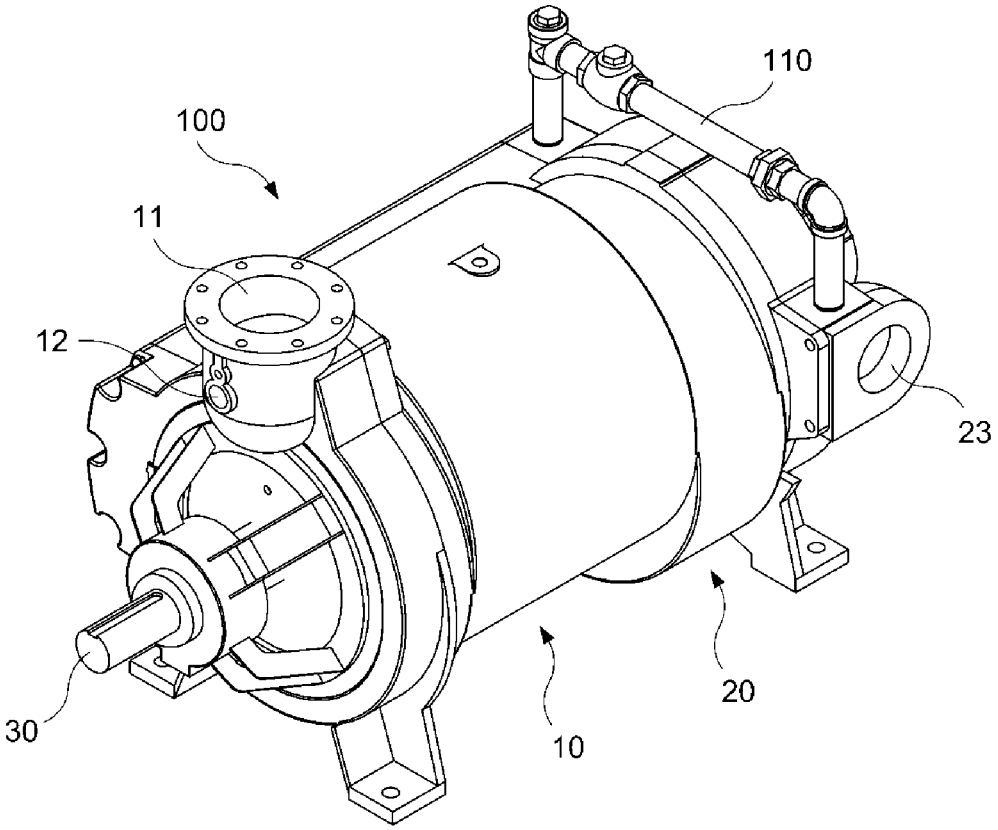

[FIG. 2]
Prior Art
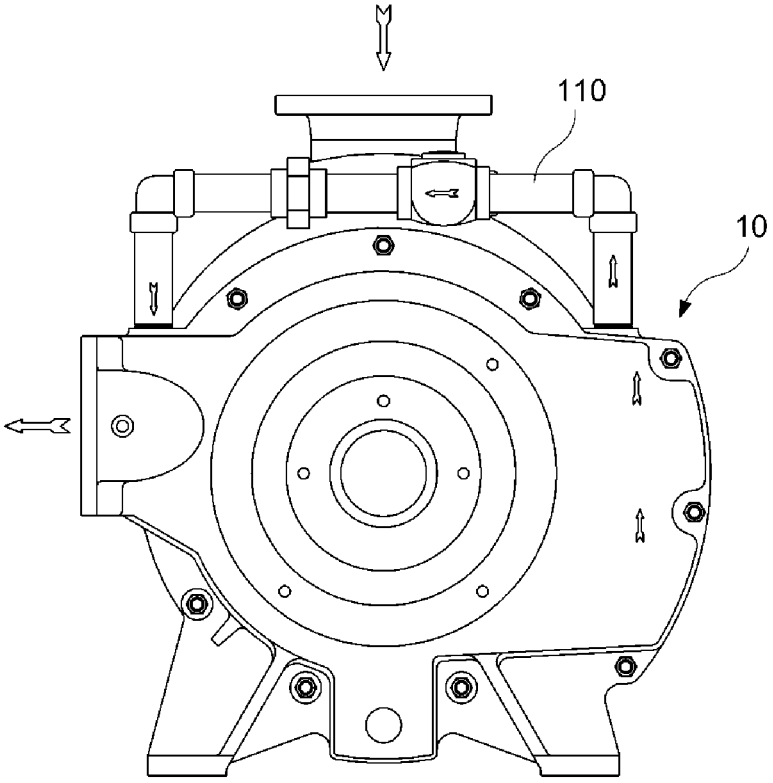

[FIG. 3]
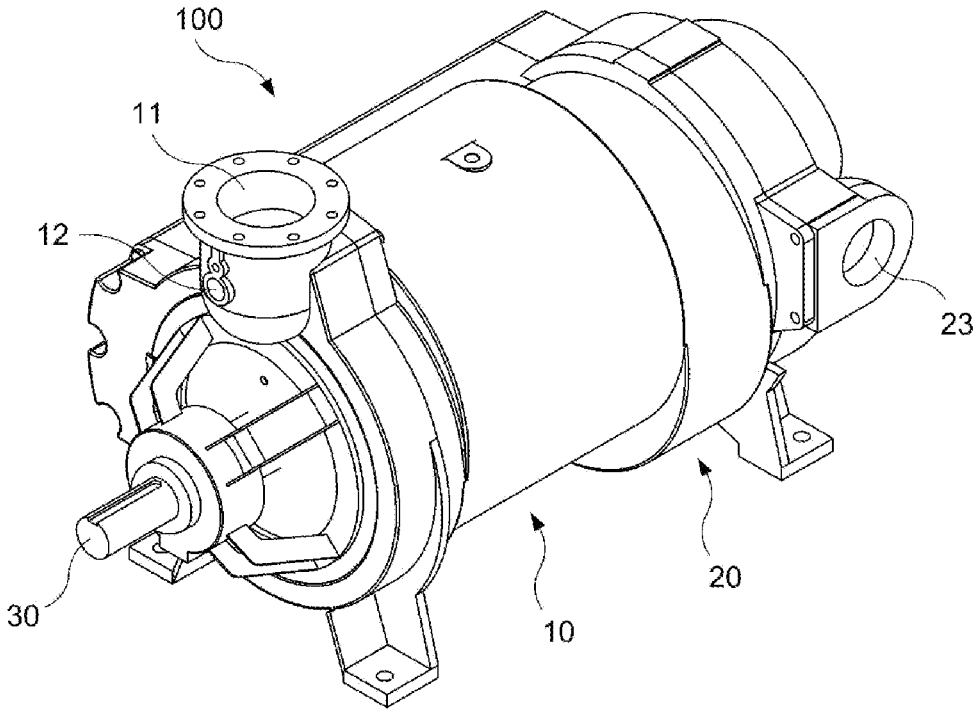
[FIG. 4]
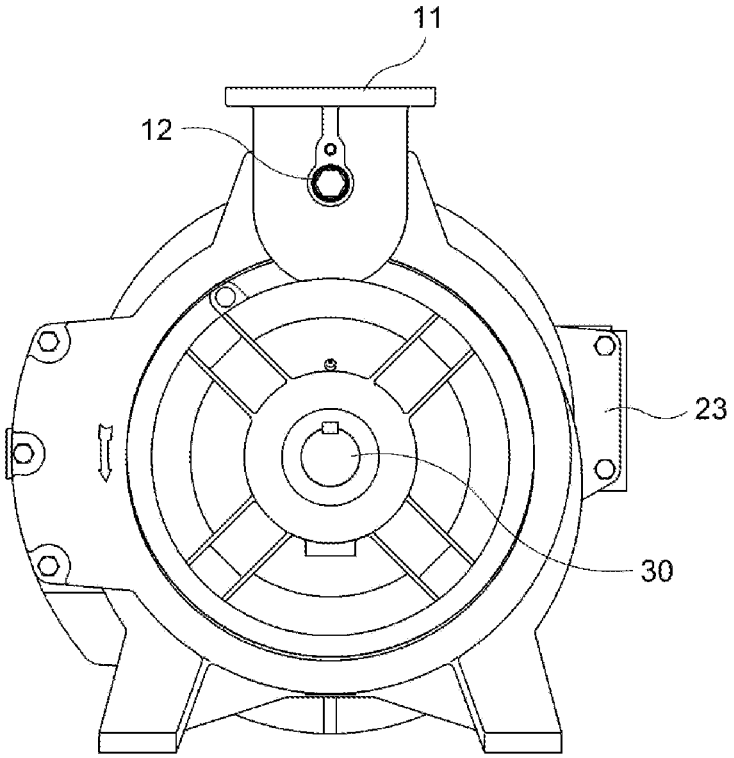

[FIG. 5]
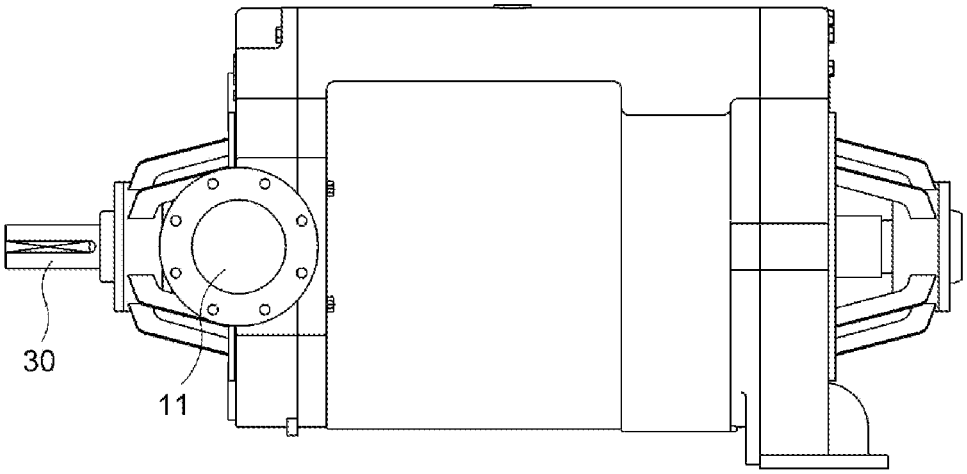
[FIG. 6]
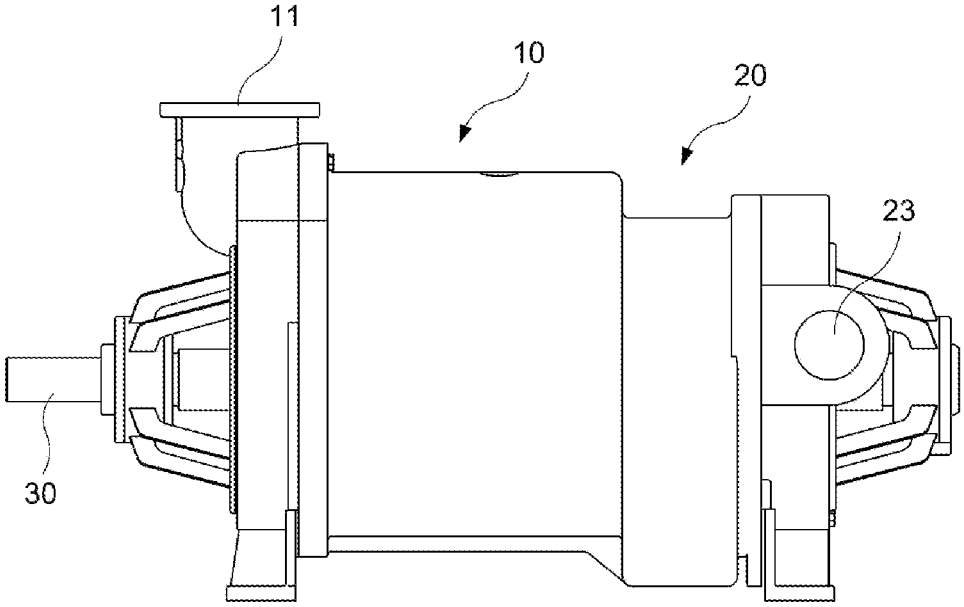

[FIG. 7]
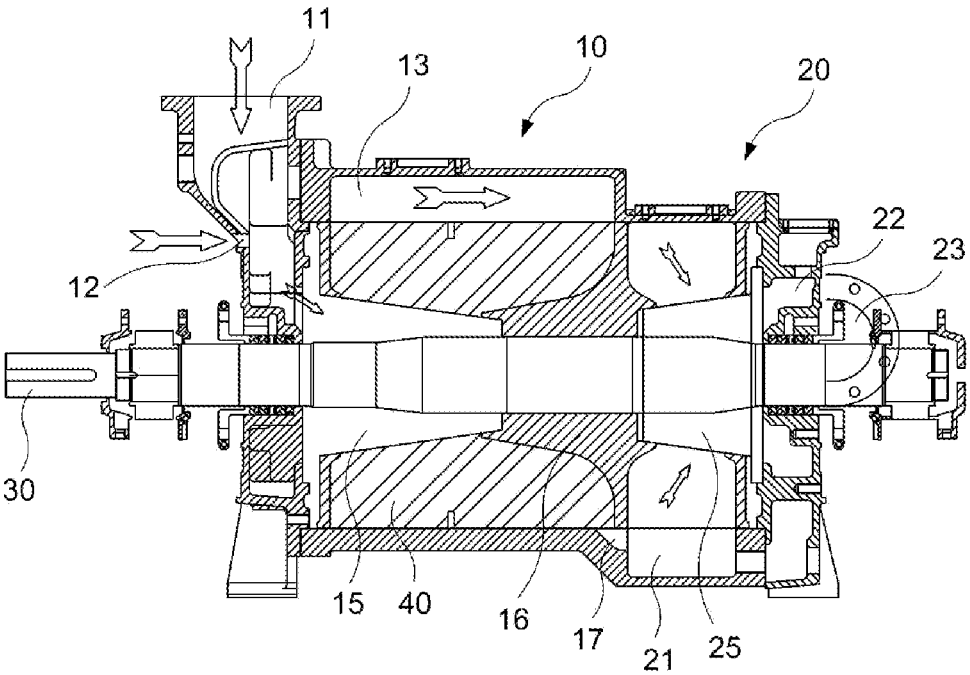
[FIG. 8]
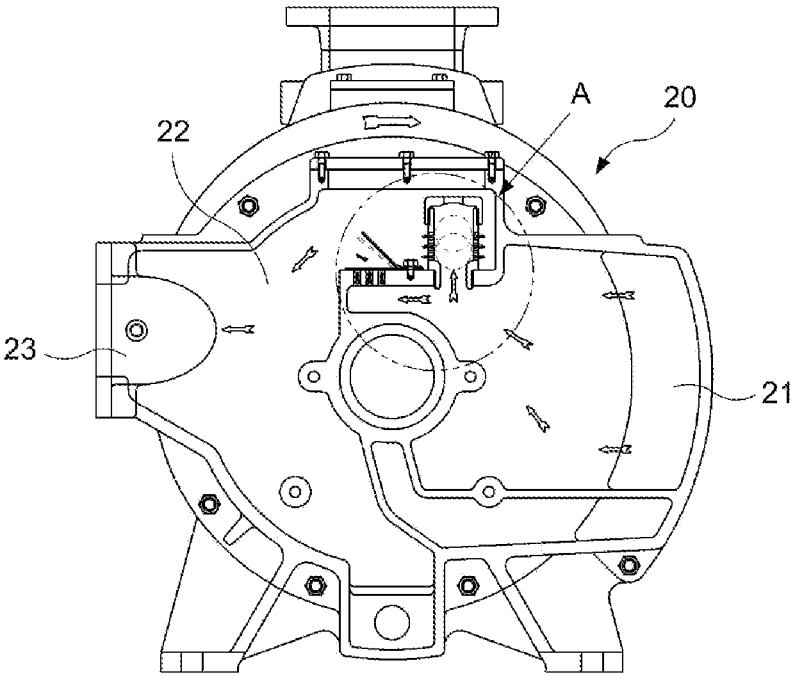

[FIG. 9]
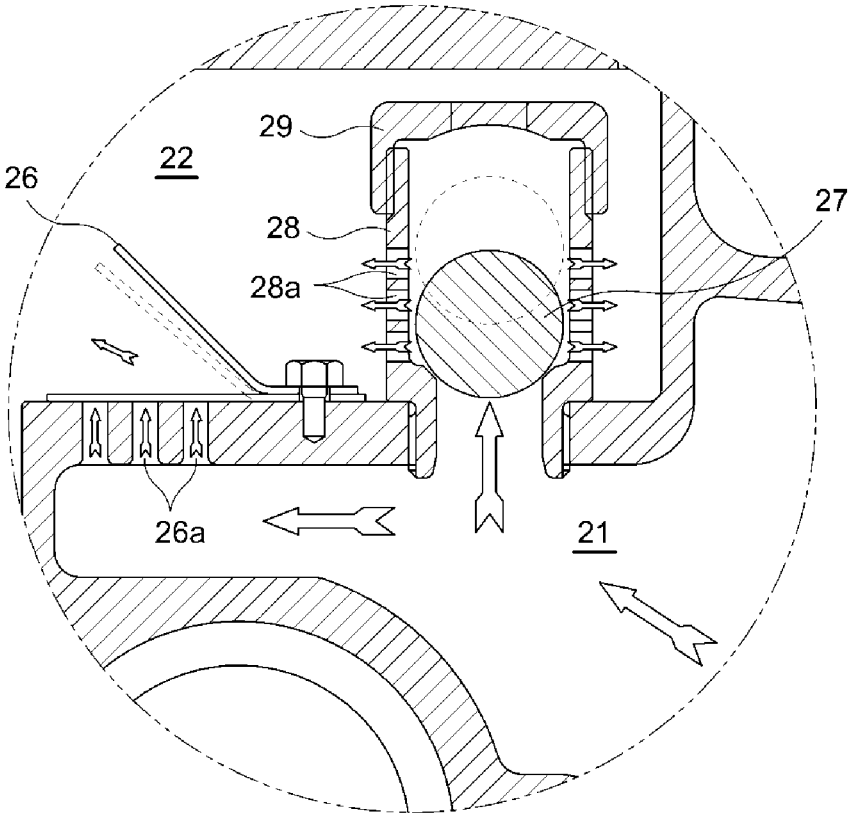
"A"

[FIG. 10]
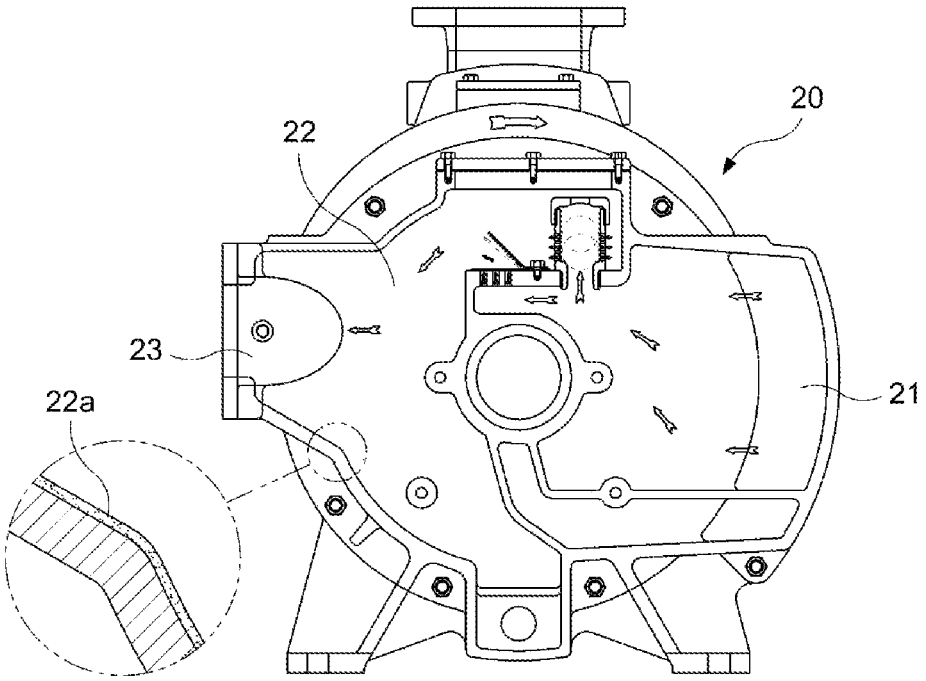

WATER-RING VACUUM PUMP INCLUDING BUILT-IN HOGGING FLOW PATH

BACKGROUND OF THE INVENTION

Field of the Invention

The present invention relates to a water-ring vacuum pump, and more particularly to a water-ring vacuum pump including a built-in hogging flow path configured to change an external hogging flow path of the related art to a built-in hogging flow path, thereby making it possible to prevent gas leakage due to pipe breakage and improve the stability and durability of the pump.

Description of the Related Art

In general, a water-ring vacuum pump includes an eccentrically disposed impeller configured to generate centrifugal force that rotates liquid filled therein using rotational force of the impeller, thereby compressing gas and transporting the same. There are two types of water-ring vacuum pumps, namely a low-pressure vacuum pump in the pressure range near atmospheric pressure such as a vane pump and a Roots pump, and a high-pressure vacuum pump configured to form a gradually higher vacuum from atmospheric pressure through low vacuum pressure to high vacuum pressure.

Meanwhile, in consideration of the characteristics of the high-pressure vacuum pump, when a high-pressure vacuum is formed, only a small amount of air can be suctioned compared to a low-pressure vacuum. Accordingly, during low-pressure vacuum operation, the high-pressure vacuum pump performs the function of the low-pressure vacuum pump through a hogging booster pipe in order to bypass a two-stage area in which the high-pressure vacuum is possible. When a certain high vacuum pressure is reached, the high-pressure vacuum pump is passed through the two-stage area rather than bypassing the same by closing a check valve installed in the pipe, thereby performing operation as a high-pressure vacuum pump.

However, in the case of a water-ring vacuum pump 100 of the related art, since a hogging pipe 110 is formed as an external type as shown in FIGS. 1 and 2, leakage of used gas and pipe interference due to an accident in which the hogging pipe 110 burns may occur during transportation, installation, and operation.

RELATED ART DOCUMENT

Patent Document (Patent Document 1) KR 2027219 (Registered on Sep. 25, 2019)

(Patent Document 2) KR 1694397 (Registered on Jan. 3, 2017)

(Patent Document 3) KR 433185 (Registered on May 17, 2004)

SUMMARY OF THE INVENTION

Therefore, the present invention has been made in view of the above problems, and it is an object of the present invention to change an external hogging booster line of the related art to a built-in hogging booster line, thereby meeting technical requirements according to the characteristics of a check valve and preventing gas leakage due to pipe breakage.

In accordance with the present invention, the above and other objects can be accomplished by the provision of a water-ring vacuum pump including a first-stage body including a gas inlet port through which gas is suctioned and a seal water supply port through which seal water is supplied, wherein each of the gas inlet port and the seal water supply port is provided on one side of the first-stage body, a second-stage body including a mixed fluid outlet port through which a mixed fluid of the introduced gas and seal water is discharged, wherein the second-stage body is coupled to the other side of the first-stage body, and an impeller configured to be rotated at high speed by an internal drive shaft penetrating the first-stage body and the second-stage body, wherein the first-stage body has a fluid-mixing space provided therein, wherein the fluid-mixing space has a mixed flow of the gas and the seal water therein, wherein the mixed flow is performed by driving the impeller, and wherein the second-stage body has a fluid guide space and an internal hogging flow path provided therein, wherein the fluid guide space guides a fluid supplied from the fluid-mixing space and the internal hogging flow path communicates with the fluid guide space to guide the mixed fluid to the mixed fluid outlet port.

BRIEF DESCRIPTION OF THE DRAWINGS

The above and other objects, features, and other advantages of the present invention will be more clearly understood from the following detailed description taken in conjunction with the accompanying drawings, in which:

FIG. 1 is an external structural view of a water-ring vacuum pump including an external hogging pipe of the related art;

FIG. 2 is a front structural view of the water-ring vacuum pump including the external hogging pipe of the related art;

FIG. 3 is an external structural view of a water-ring vacuum pump including a built-in hogging flow path according to an embodiment of the present invention;

FIG. 4 is a front structural view of the water-ring vacuum pump of the present invention;

FIG. 5 is a plan view of the water-ring vacuum pump of the present invention;

FIG. 6 is a side structural view of the water-ring vacuum pump of the present invention;

FIG. 7 is a cross-sectional view of the inside of the water-ring vacuum pump of the present invention;

FIG. 8 is a view showing mixed fluids being discharged from the water-ring vacuum pump of the present invention;

FIG. 9 is an enlarged view of a portion A in FIG. 8; and

FIG. 10 is a cross-sectional structural view of a coating state of a hogging flow path according to another embodiment of the present invention.

DETAILED DESCRIPTION OF THE INVENTION

Hereinafter, specific embodiments of the present invention will be described in detail with reference to the accompanying drawings.

Embodiments of the present invention may be modified in various forms, and the scope of the present invention should not be construed as being limited to the embodiments described in detail below. The embodiments are provided to more completely describe the present invention to those of ordinary skill in the art.

Accordingly, the shapes of components shown in the drawings may be exaggerated to promote a clearer description thereof. Wherever possible, the same reference numbers will be used throughout the drawings to refer to the same or like parts. In addition, detailed descriptions of functions and configurations of the known technology determined to unnecessarily obscure the gist of the present invention may be omitted.

First, the configuration of a water-ring vacuum pump including a built-in hogging flow path according to an embodiment of the present invention will be described with reference to the drawings shown in FIGS. 3 to 9 as follows.

The water-ring vacuum pump of the embodiment includes a first-stage body 10 including a gas inlet port 11 through which gas is suctioned and a seal water supply port 12 through which seal water is supplied, wherein each of the gas inlet port 11 and the seal water supply port 12 is provided on one side of the first-stage body 10, a second-stage body 20 including a mixed fluid outlet port 23 through which a mixed fluid of the introduced gas and seal water is discharged, wherein the second-stage body 20 is coupled to the other side of the first-stage body 10, and an impeller configured to be rotated at high speed by an internal drive shaft 30 penetrating the first-stage body 10 and the second-stage body 20.

Particularly, in the present invention, the first-stage body 10 has a fluid-mixing space 13 provided therein. Here, the fluid-mixing space 13 has a mixed flow of the gas and the seal water therein, and the mixed flow is performed by driving the impeller 40. Further, the second-stage body has a fluid guide space 21 and an internal hogging flow path 22 respectively provided therein. Here, the fluid guide space 21 guides the fluid supplied from the fluid-mixing space 13 and the internal hogging flow path 22 communicates with the fluid guide space 21 to guide the mixed fluid to the mixed fluid outlet port 23.

Additionally, in the second-stage body 20, any one of a plate check valve 26 made of titanium and a ball check valve 27 made of titanium may be optionally formed between the fluid guide space 21 and the internal hogging flow path 22, or the plate check valve 26 and the ball check valve 27 may be formed together therebetween. Here, the plate check valve 26 and the ball check valve 27 limit fluid movement therebetween.

In this case, the plate check valve 26 forms a plate shape configured to open and close a distribution hole 26*a* formed between the fluid guide space 21 and the internal hogging flow path 22, and the ball check valve 27 is formed to be movable upwards and downwards with respect to a guide pipe 28 having a plurality of distribution holes 28*a* formed therein. Here, a separation prevention part 29 configured to prevent separation of the ball check valve 27 is coupled to the upper portion of the guide pipe 28.

Meanwhile, in this embodiment, the water-ring vacuum pump has a partition wall 16 formed therein. Here, the partition wall 16 partitions the first-stage body 10 from the second-stage body 20. Further, a distribution hole 17 configured to connect the fluid-mixing space 13 to the fluid guide space 21 is formed in the lower portion of the partition wall 16.

In the drawings, reference numerals 15 and 25, which are not described herein, respectively represent a first stage cone and a second stage cone.

Action effects according to the operation of the water-ring vacuum pump including the built-in hogging flow path of the present invention having such a configuration will be described.

The water-ring vacuum pump in this embodiment has a two-stage structure suitable for high-pressure vacuum operation, and has a characteristic of minimizing the time to reach a vacuum strength required by a customer from atmospheric pressure.

Here, in the present invention, since a hogging flow path configured to guide a fluid to the mixed fluid outlet port 23 is formed as the internal hogging flow path 22 instead of the external structure of the related art, the mixed fluid of gas and seal water, which are mixed in the fluid-mixing space 13 in the first-stage body 10, is guided to the internal hogging flow path 22 through the fluid guide space 21 of the second-stage body 20.

Particularly, since the plate check valve 26 or the ball check valve 27 is formed between the fluid guide space 21 and the internal hogging flow path 22, it is possible to stably control the flow of the fluid according to the characteristics of each check valve depending on the vacuum strength and the fluid pressure.

In addition, it is possible to more smoothly perform internal guidance of the fluid through the distribution hole 17 formed in the lower portion of the partition wall 16.

Therefore, in the water-ring vacuum pump of the present invention, a flow path having a hogging booster function is formed as a built-in type, thereby having an effect of preventing damage and gas leakage due to the external structure of the related art and thus improving stability and durability.

Meanwhile, FIG. 10 is a view showing the configuration of a water-ring pump according to another embodiment of the present invention. Here, the inner wall surface of the internal hogging flow path 22 is coated with a hogging coating layer 22*a* configured to reduce frictional force with a fluid.

In this case, the hogging coating layer 22*a* may preferably form a mixed composition containing 40 to 60 wt % of amino resin, 15 to 30 wt % of polyoxyethylene, 10 to 20 wt % of sodium hydroxide, 1 to 15 wt % of α-benzyl acrylic acid, 1 to 10 wt % of propylene glycol, and 1 to 10 wt % of phenoxyethanol.

When the hogging coating layer 22*a* is formed as described above, the frictional force of the fluid discharged to the mixed fluid outlet port 23 through the internal hogging flow path 22 is reduced, thereby making it possible to improve noise reduction and discharge efficiency.

Particularly, since a polyoxyethylene component is mixed in the hogging coating layer 22*a*, the surface lubricity of the coating layer is improved, sodium hydroxide, which is a strong basic aqueous solution, prevents discoloration and deterioration of the hogging coating layer 22*a*, and α-benzyl acrylic acid allows the coating layer according to the catalytic action of amino resin to be formed to a uniform thickness overall. In addition, each of the additionally added propylene glycol and phenoxyethanol has an effect of improving the durability of the hogging coating layer 22*a* and preventing cracks in the coating surface due to changes in the internal pressure in the vacuum atmosphere.

As is apparent from the above description, a water-ring vacuum pump of the present invention includes a built-in flow path having a hogging booster function, thereby having an effect of preventing damage and gas leakage due to the external structure of the related art and thus improving stability and durability.

Further, a plate check valve system and a ball check valve system are applied to the water-ring vacuum pump, thereby making it possible to secure stability of fluid movement according to the characteristics of a check valve, durability, and selection of appropriate material.

Although preferred embodiments of the present invention have been disclosed for illustrative purposes, those skilled in the art will appreciate that the water-ring vacuum pump structure of the present invention can be modified in various ways.

However, such modifications should not be understood as being separate from the technical spirit or scope of the present invention, and such modifications should be included within the scope of the appended claims of the present invention.

What is claimed is:

1. A water-ring vacuum pump comprising a built-in hogging flow path, the water-ring vacuum pump comprising:

a first-stage body comprising a gas inlet port through which gas is suctioned and a seal water supply port through which seal water is supplied, wherein each of the gas inlet port and the seal water supply port is provided on one side of the first-stage body;

a second-stage body comprising a mixed fluid outlet port through which a mixed fluid of the introduced gas and seal water is discharged, wherein the second-stage body is coupled to the other side of the first-stage body; and an impeller configured to be rotated by an internal drive shaft penetrating the first-stage body and the second-stage body, wherein:

the first-stage body has a fluid-mixing space provided therein, wherein the fluid-mixing space has a mixed flow of the gas and the seal water therein, wherein the mixed flow is performed by driving the impeller, and the second-stage body has a fluid guide space and an internal hogging flow path provided therein, wherein the fluid guide space guides a fluid supplied from the fluid-mixing space and the internal hogging flow path communicates the mixed fluid in the fluid guide space with the mixed fluid outlet port, the water-ring vacuum pump further comprising a partition wall formed therein, wherein the partition wall partitions the first-stage body from the second-stage body, wherein a distribution hole configured to connect the fluid-mixing space to the fluid guide space is formed in a radially outer portion of the partition wall.

2. The water-ring vacuum pump according to claim 1, wherein the second-stage body has a plate check valve formed therein, wherein the plate check valve opens and closes a distribution hole formed between the fluid guide space and the internal hogging flow path.

3. The water-ring vacuum pump according to claim 1, wherein the second-stage body has a ball check valve made of titanium formed therein, wherein the ball check valve is disposed between the fluid guide space and the internal hogging flow path and is formed to be movable with respect to a guide pipe having a plurality of distribution holes formed therein, wherein a separation prevention part configured to secure the ball in the check valve is coupled to an upper portion of the guide pipe.

4. The water-ring vacuum pump according to claim 1, wherein the internal hogging flow path has an inner wall surface thereof coated with a hogging coating layer configured to reduce friction, wherein the hogging coating layer forms a mixed composition of amino resin, polyoxyethylene, sodium hydroxide, α-benzyl acrylic acid, propylene glycol, and phenoxyethanol.

* * * * *